US011296472B2

(12) United States Patent
Kerstetter et al.

(10) Patent No.: US 11,296,472 B2
(45) Date of Patent: Apr. 5, 2022

(54) HAND CRIMP TOOL HAVING WIRE INSERTER

(71) Applicant: TE CONNECTIVITY CORPORATION, Berwyn, PA (US)

(72) Inventors: Chadwick Alan Kerstetter, Richfield, PA (US); Caleb Andrew Moyer, Harrisburg, PA (US)

(73) Assignee: TE Connectivity Services GmbH

( * ) Notice: Subject to any disclaimer, the term of this patent is extended or adjusted under 35 U.S.C. 154(b) by 569 days.

(21) Appl. No.: 16/157,197

(22) Filed: Oct. 11, 2018

(65) Prior Publication Data

US 2020/0119506 A1 Apr. 16, 2020

(51) Int. Cl.
*H01R 43/045* (2006.01)
*H01R 43/042* (2006.01)

(52) U.S. Cl.
CPC ..... *H01R 43/045* (2013.01); *H01R 43/0421* (2013.01); *H01R 43/042* (2013.01); *Y10T 29/53226* (2015.01)

(58) Field of Classification Search
CPC ..... H01R 43/0421; H01R 43/045; H01R 43/042; Y10T 29/53222; Y10T 29/53235; Y10T 29/53257
See application file for complete search history.

(56) References Cited

U.S. PATENT DOCUMENTS 3,076,256 A 2/1963 Broske
4,534,107 A * 8/1985 Maack ..... Y10T 29/53235 29/751
2016/0254631 A1* 9/2016 Virkler ..... H01R 43/0421 29/751
2018/0115132 A1 4/2018 Glockseisen et al.

FOREIGN PATENT DOCUMENTS

JP 2009140769 A * 6/2009

OTHER PUBLICATIONS

International Search Report, International Application No. PCT/IB2019/058605, International Filing Date, Oct. 9, 2019.

* cited by examiner

*Primary Examiner* — A. Dexter Tugbang

(57) ABSTRACT

A hand crimp tool includes a handle having upper and lower handles having upper and lower handgrips hand squeezed to close the hand crimp tool. The hand crimp tool includes a head having upper and lower jaws defining a crimp zone therebetween. The lower jaw includes an anvil holding a terminal and the upper jaw includes a crimper crimping the terminal. The hand crimp tool includes a wire inserter coupled to the head having a carriage movable between an advanced position and a retracted position. The wire inserter has a wire clamp holding a wire in the carriage and the wire inserter moves the wire relative to the head to position and hold the wire in the terminal during crimping of the terminal between the anvil and the crimper.

20 Claims, 5 Drawing Sheets

HAND CRIMP TOOL HAVING WIRE INSERTER

BACKGROUND OF THE INVENTION

The subject matter herein relates generally to hand crimp tools.

Crimping machines are used to crimp terminals to wires. Various crimping machines are electrically actuated using a motor to drive the crimper to crimp the terminal to the wire. Such machines use a device to automatically position the wire in the crimp zone by controlling the position of the end of the wire in the crimp zone. Other various crimping machines are hand tools used to crimp the terminal to the wire. Such hand tools are hand crimped by squeezing the tool by hand. The wire is typically held in one hand of the operator and the tool is squeezed by the operator's other hand. However, the wire may be inconsistently positioned, leading to variations in the manufactured assemblies. Additionally, if the wire is inserted with too little force, the terminal may be improperly crimped to the wire and may be inoperable leading to waste.

A need remains for a hand crimp tool that repeatably and reliably positions the wire in the crimp zone during the crimping operation.

BRIEF DESCRIPTION OF THE INVENTION

In one embodiment, a hand crimp tool is provided including a handle including an upper handle and a lower handle movable relative to each other to open and close the hand crimp tool. The upper handle includes an upper handgrip and the lower handle includes a lower handgrip. The upper handgrip and the lower handgrip are configured to be hand squeezed to close the hand crimp tool. The hand crimp tool includes a head having an upper jaw operably coupled to the upper handle and a lower jaw operably coupled to the lower handle. The head includes a crimp zone between the upper jaw and the lower jaw. The lower jaw includes an anvil configured to hold a terminal and the upper jaw includes a crimper configured to crimp the terminal between the anvil and the crimper when the hand crimp tool is closed. The hand crimp tool includes a wire inserter coupled to the head. The wire inserter includes a carriage movable between an advanced position and a retracted position. The wire inserter has a wire clamp holding a wire in the carriage and the wire inserter moves the wire relative to the head to position and hold the wire in the terminal during crimping of the terminal between the anvil and the crimper.

In another embodiment, a hand crimp tool is provided including a handle including an upper handle and a lower handle movable relative to each other to open and close the hand crimp tool. The upper handle includes an upper handgrip and the lower handle includes a lower handgrip. The upper handgrip and the lower handgrip are configured to be hand squeezed to close the hand crimp tool. The hand crimp tool includes a head having an upper jaw operably coupled to the upper handle and a lower jaw operably coupled to the lower handle. The head includes a crimp zone between the upper jaw and the lower jaw. The lower jaw includes an anvil configured to hold a terminal and the upper jaw includes a crimper configured to crimp the terminal between the anvil and the crimper when the hand crimp tool is closed. The hand crimp tool includes a wire inserter coupled to the head. The wire inserter includes an end piece and guide rails extending from the end piece to the head. The guide rails are coupled to the head. The wire inserter includes a carriage slidable along the guide rails between an advanced position and a retracted position. The carriage is closer to the head in the advanced position than in the retracted position but the carriage is closer to the end piece in the retracted position than in the advanced position. The carriage holds a wire and moving the wire relative to the head to position the wire in the terminal during crimping of the terminal between the anvil and the crimper.

In one embodiment, a hand crimp tool is provided including a handle including an upper handle and a lower handle movable relative to each other to open and close the hand crimp tool. The upper handle includes an upper handgrip and the lower handle includes a lower handgrip. The upper handgrip and the lower handgrip are configured to be hand squeezed to close the hand crimp tool. The hand crimp tool includes a head having an upper jaw operably coupled to the upper handle and a lower jaw operably coupled to the lower handle. The head includes a crimp zone between the upper jaw and the lower jaw. The lower jaw includes an anvil configured to hold a terminal and the upper jaw includes a crimper configured to crimp the terminal between the anvil and the crimper when the hand crimp tool is closed. The hand crimp tool includes a terminal locator coupled to the head proximate to the anvil. The terminal locator has a terminal channel configured to receive the terminal oriented relative to the anvil. The terminal locator has a terminal lock configured to lock the terminal in the terminal channel. The hand crimp tool includes a wire inserter coupled to the head. The wire inserter includes a carriage movable between an advanced position and a retracted position. The wire inserter has a wire clamp holding a wire in the carriage and the wire inserter moves the wire relative to the head to position and hold the wire in the terminal during crimping of the terminal between the anvil and the crimper.

DETAILED DESCRIPTION OF THE INVENTION

Figure 1:
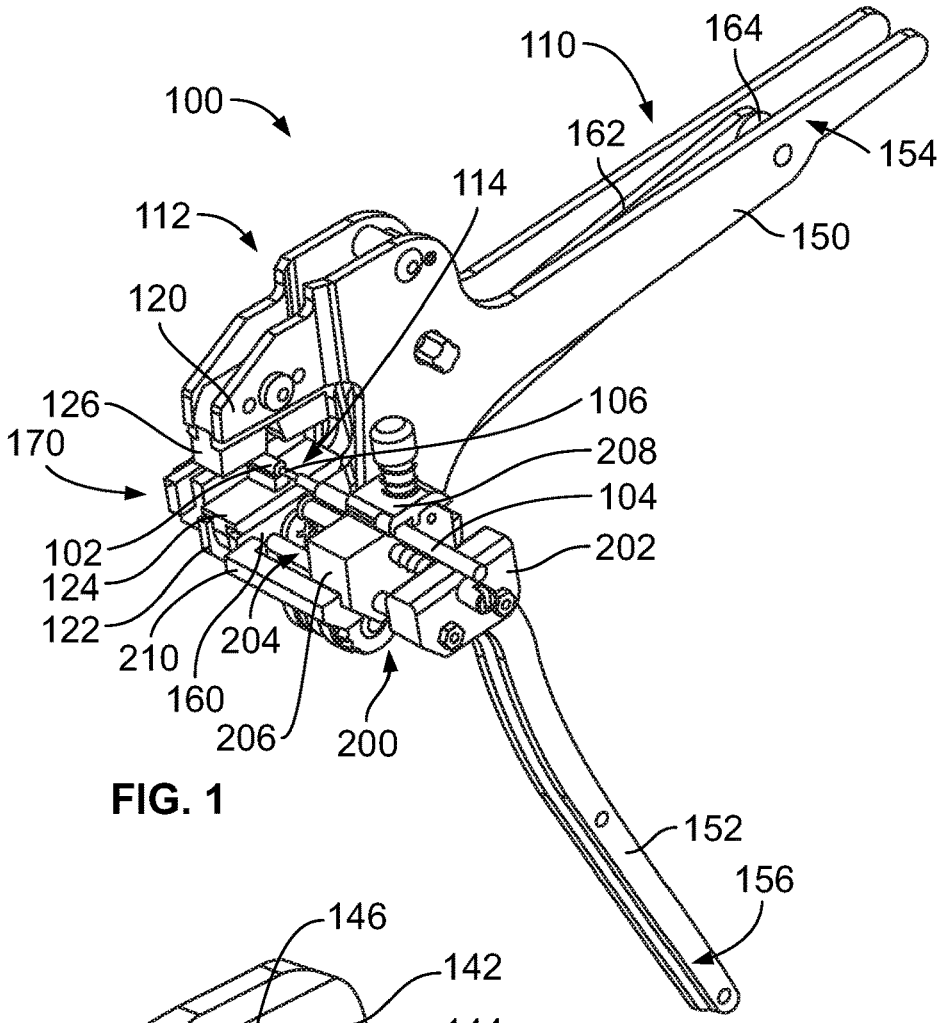
FIG. 1 is a perspective view of a hand crimp tool in accordance with an exemplary embodiment.

FIG. 1 is a perspective view of a hand crimp tool 100 in accordance with an exemplary embodiment. The hand crimp tool 100 is used for hand crimping a terminal 102 to a wire 104. For example, the hand crimp tool 100 may be opened and closed during a crimping process to crimp the terminal 102 to the wire 104. The hand crimp tool 100 is hand actuated by an operator to close the hand crimp tool 100 during the crimping process. In an exemplary embodiment, a contact 106 is provided at the end of the wire 104 and loaded into the terminal 102 with the wire 104. The terminal 102 is crimped to the wire 104 around the contact 106. For example, the contact 106 defines a center contact terminated to a center conductor of the wire 104 and the terminal 102 defines an outer contact terminated to a shield of the wire 104. In other various embodiments, the wire 104 is provided without the contact 106 and the terminal 102 is terminated to the center conductor of the wire 104.

The hand crimp tool 100 includes a handle 110 and a head 112 at the end of the handle 110. The head 112 defines a crimp zone 114 and holds the terminal 102 in the crimp zone 114 for crimping the terminal 102 during the crimping process. A wire inserter 200 is provided at the head 112 for loading the wire 104 into the crimp zone 114. The wire inserter 200 positions the wire 104 in the crimp zone 114 and holds the wire 104 in the terminal 102 during the crimping process. In an exemplary embodiment, the wire inserter 200 holds the wire 104 in the terminal 102 using a spring force to position the wire 104 and/or the contact 106 in the terminal 102.

The head 112 includes an upper jaw 120 and a lower jaw 122. The handle 110 actuates the upper jaw 120 and/or the lower jaw 122 during the crimping process to crimp the terminal 102 around the wire 104. The crimp zone 114 is defined between the upper jaw 120 and the lower jaw 122. The lower jaw 122 includes an anvil 124 that supports the terminal 102 in the crimp zone 114. The upper jaw 120 includes a crimper 126 that crimps the terminal 102 between the crimper 126 and the anvil 124 during the crimping process when the hand crimp tool 100 is closed. In various embodiments, the crimper 126 and the anvil 124 are removable and replaceable within the jaws 120, 122 for crimping different sized and shaped terminals 102.

Figure 2:
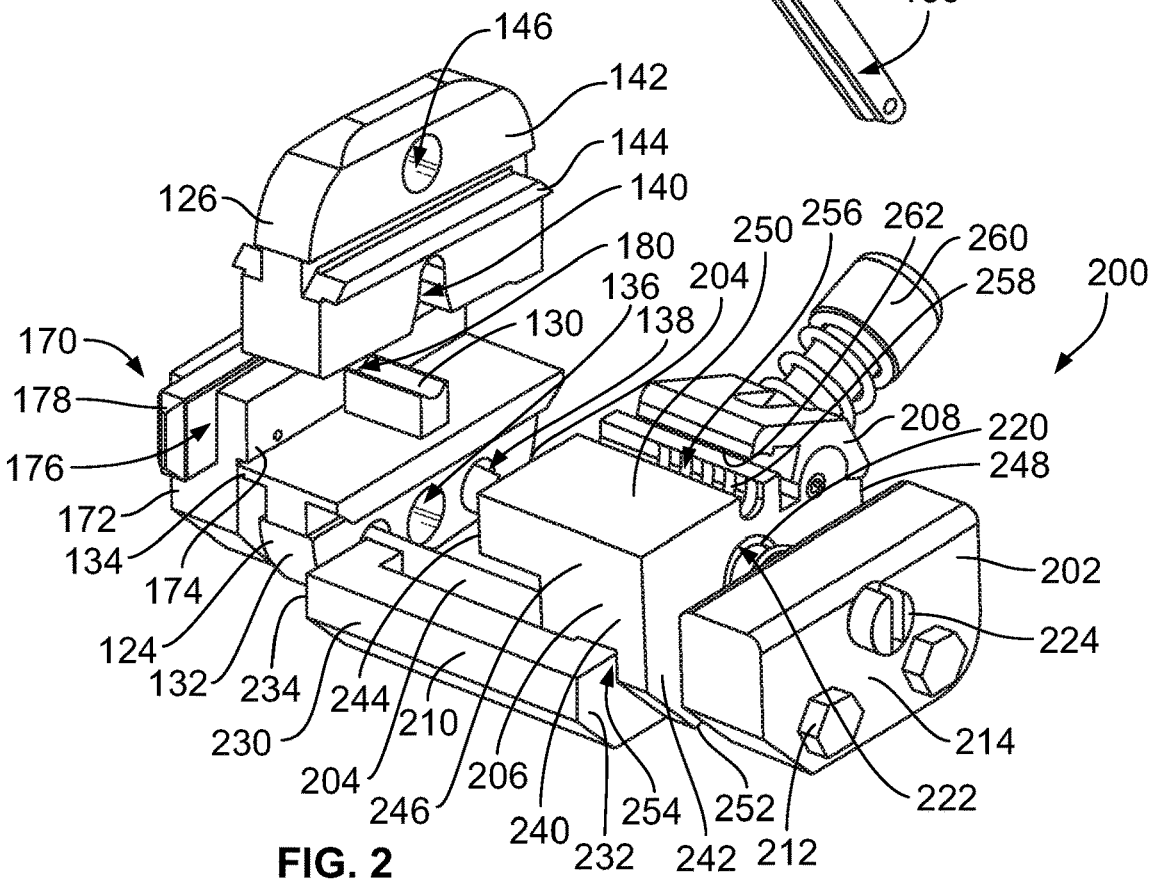
FIG. 2 is a perspective view of a portion of the hand crimp tool illustrating a wire inserter in accordance with an exemplary embodiment.

With reference to FIG. 2, in an exemplary embodiment, the anvil 124 includes a terminal support 130 having a profile that corresponds to the terminal 102 to support the terminal 102 from below during the crimping process. The terminal 102 may be formed against the terminal support 130 during the crimping process. The anvil 124 includes a base 132 below the terminal support 130. Optionally, the base 132 is coupled to the head 112 and/or the handle 110. In various embodiments, the anvil 124 includes a ledge 134 at the top of the base 132. The ledge 134 may rest on the lower jaw 122 of the head 112 and/or on the handle 110 to position the anvil 124 within the hand crimp tool 100.

With reference to FIG. 2, in an exemplary embodiment, the crimper 126 includes a crimper slot 140 that receives the terminal 102 and forms the terminal 102 during the crimping process. The crimper slot 140 has a predetermined profile that is used to shape the terminal 102 during the crimping process. For example, legs of the terminal 102 may be folded over by the crimper 126 when received in the crimper slot 140 during the crimping process. The crimper 126 includes a base 142 coupled to the head 112 and/or the handle 110. In various embodiments, the crimper 126 includes a ledge 144 below the base 142. The ledge 144 may be supported by the upper jaw 120 of the head 112 and/or the handle 110 to position the crimper 126 within the hand crimp tool 100.

The handle 110 includes an upper handle 150 and a lower handle 152 movable relative to each other to open and close the hand crimp tool 100. The upper handle 150 includes an upper handgrip 154 and the lower handle 152 includes a lower handgrip 156. The upper handgrip 154 and the lower handgrip 156 are hand squeezed together by the operator to close the hand crimp tool 100. In an exemplary embodiment, the front end of the upper handle 150 defines part of the head 112, such as the upper jaw 120. Optionally, the front end of the lower handle 152 may define part of the head 112, such as the lower jaw 120.

In various embodiments, such as in the illustrated embodiment, the handle 110 includes a clamp 160 operably coupled between the upper handle 150 and the lower handle 152. The clamp 160 includes a lever 162 coupled to the upper handle 150. The front end of the clamp 160 defines part of the head 112, such as the lower jaw 122. When the lower handle 152 is squeezed closed, the lower handle 152 presses against the clamp 160 to close the lower jaw 122 to crimp the terminal 102 to the wire 104. For example, the lower handle 152 may be pivotably coupled to the upper handle 150 and include a cam surface that engages the clamp 160 to close the lower jaw 122 when the lower handle 152 is hand squeezed closed.

The hand crimp tool 100 may be opened and closed by other means in alternative embodiments. For example, the hand crimp tool 100 may be provided without the clamp 160, such as with the lower handle 152 defining the lower jaw 122 that is opened and closed by opening and closing the lower handle 152 relative to the upper handle 150. Optionally, the hand crimp tool 100 may include a return spring 164 coupled between the upper handle 150 and the clamp 160 and/or the lower handle 152. The return spring 164 may force the lower jaw 122 to open relative to the upper jaw 120.

In an exemplary embodiment, the hand crimp tool 100 includes a terminal locator 170 coupled to the head 112 at the crimp zone 114. Optionally, the terminal locator 170 is coupled to the lower jaw 122 opposite the wire inserter 200. For example, the wire inserter 200 is on a first side of the anvil 124 and the terminal locator 170 is on an opposite second side of the anvil 124. The terminal locator 170 supports the terminal 102 relative to the anvil 124. Optionally, the terminal locator 170 may lock the position of the terminal 102 relative to the anvil 124 during loading of the wire 104 into the terminal 102 and during the crimping process. The terminal locator 170 may release the terminal 102 after the terminal 102 is crimped to the wire 104.

The wire inserter 200 is coupled to the head 112 proximate to the crimp zone 114. In the illustrated embodiment, the wire inserter 200 is coupled to the lower jaw 122 and is movable with the lower jaw 122. The wire inserter 200 includes a end piece 202 mounted to the lower jaw 122 by guide rails 204. The wire inserter 200 includes a carriage 206 slidable along the guide rails 204 between the end piece 202 and the lower jaw 122. The carriage 206 holds the wire 104 and moves the wire 104 into the terminal 102. In an exemplary embodiment, the carriage 206 includes a wire clamp 208 operable to hold the wire 104 relative to the carriage 206. The wire clamp 208 may be released to release the wire 104 from the carriage 206. In an exemplary embodiment, the carriage 206 includes a carriage lock 210 configured to lock the position of the carriage 206 relative to the end piece 202, such as for loading the wire 104 into the carriage 206. The carriage lock 210 may be unlocked to allow the carriage 206 to advance the wire 104 into the terminal 102.

FIG. 2 is a perspective view of a portion of the hand crimp tool 100 illustrating the wire inserter 200 relative to the anvil 124 and the crimper 126. FIG. 2 also illustrates the terminal locator 170. In an exemplary embodiment, the base 142 of the crimper 126 includes an opening 146 for receiving a pin or fastener for securing the crimper 126 to the upper jaw 120 (shown in FIG. 1). In an exemplary embodiment, the anvil 124 includes an opening 136 for receiving a pin or fastener for securing the anvil 124 to the lower jaw 122 (shown in FIG. 1). In an exemplary embodiment, the anvil 124 includes guide openings 138 that receive the guide rails 204 of the wire inserter 200 to position the wire inserter 200 relative to the anvil 124. The guide rails 204 guide movement of the carriage 206 relative to the anvil 124 for positioning the wire 104 relative to the terminal 102 (both shown in FIG. 1).

The terminal locator 170 is configured to be mounted to the anvil 124 and/or the lower jaw 122 (shown in FIG. 1). The terminal locator 170 includes a body 172 having a shoulder 174 that rests on the anvil 124. The shoulder 174 positions the terminal locator 170 relative to the anvil 124. In the illustrated embodiment, the shoulder 174 rest on top of the ledge 134. The shoulder 174 may engage other portions of the anvil 124 in alternative embodiments. The terminal locator 170 includes a slot 176 that receives a terminal lock 178. The terminal lock 178 is slidable in the slot 176 to engage the terminal 102 and lock the terminal 102 in the terminal locator 170. In an exemplary embodiment, the terminal locator 170 includes a terminal channel 180 that receives the terminal 102. The terminal lock 178 is movable into the terminal channel 180 to engage the terminal 102 unlock the terminal 102 in the terminal channel 180.

In an exemplary embodiment, the guide rails 204 extend between the end piece 202 and the anvil 124. In the illustrated embodiment, the guide rails 204 are cylindrical; however, the guide rails 204 may have other shapes in alternative embodiments. The carriage 206 slides on the guide rails 204 between an advanced position and a retracted position. For example, the carriage 206 is movable toward the anvil 124 as the carriage 206 moves to the advanced position and the carriage 206 is movable away from the anvil 124 as the carriage 206 moves to the retracted position. The carriage 206 moves the wire 104 into the terminal 102 as the carriage 206 is moved to the advanced position.

Optionally, the guide rails 204 may be secured to the end piece 202 using nuts 212 or other fasteners. For example, ends of the guide rails 204 may be threaded to receive the nuts 212. The guide rails 204 fix the position of the end piece 202 relative to the anvil 124. The guide rails 204 guide movement of the carriage 206 relative to the anvil 124.

In an exemplary embodiment, the end piece 202 includes a body 214 cantilevered from and along a first side of the anvil 124 by the guide rails 204. The end piece 202 supports a biasing mechanism 220 used for biasing the carriage 206 in an advancing direction toward the advanced position. The biasing mechanism 220 is positioned between the end piece 202 and the carriage 206. The biasing mechanism 220 pushes the carriage 206 away from the end piece 202 with a predetermined loading force. In the illustrated embodiment, the biasing mechanism 220 is a coil spring; however, other types of biasing mechanisms 220 may be used in alternative embodiments. The size of the coil spring may be selected having a predetermined spring force that defines the loading force. The biasing mechanism 220 is received in an opening 222 in the carriage 206. The biasing mechanism 220 presses against a surface of the carriage 206 within the opening 222 to force the carriage 206 in the advancing direction.

The carriage lock 210 is used to lock the carriage 206 in position relative to the end piece 202, such as to hold the carriage 206 in the retracted position for loading the wire 104 into the carriage 206 and positioning the wire 104 relative to the terminal 102. When the carriage lock 210 is released, the biasing mechanism 220 advances the carriage 206 in the advancing direction.

In an exemplary embodiment, the wire inserter 200 includes a force adjustment mechanism 224 operable to adjust the loading force. For example, the force adjustment mechanism 224 is operably coupled to the biasing mechanism 220 to adjust the relative position of the biasing mechanism 220 and the end piece 202. Actuation of the force adjustment mechanism 224 changes the loading force. In the illustrated embodiment, the force adjustment mechanism 224 is a screw threadably coupled to the end piece 202. Rotation of the force adjustment mechanism 224 changes the position of the end of the biasing mechanism 220 to adjust the loading force. Other types of force adjustment mechanisms 224 may be used in alternative embodiments.

The carriage lock 210 includes a body 230 extending between a first end 232 and a second end 234. The first end 232 is coupled to the carriage 206. The second end 234 is configured to engage the lower jaw 122 of the head 112 to lock the position of the carriage 206 in the retracted position. In an exemplary embodiment, the carriage lock 210 may be moved to an unlocked position to release the carriage 206. For example, the carriage lock 210 may be slid forward to the unlocked position. In other various embodiments, the carriage lock 210 may be rotated downward to the unlocked position. Other movements are possible in alternative embodiments. Other types of locking devices may be used for the carriage lock 210 in alternative embodiments.

The carriage 206 includes a carriage body 240 extending between a first end 242 and a second end 244. The carriage body 240 includes a front 246 and a rear 248. The carriage body 240 includes a top 250 and a bottom 252. In the illustrated embodiment, the carriage lock 210 is coupled to the carriage body 240 at the front 246. For example, the carriage body 240 includes a slot 254 at the front 246 and/or the bottom 252 that receives the first end 232 of the carriage lock 210. The carriage 206 includes a wire channel 256 at the top 250 that receives the wire 104. Optionally, the wire channel 256 includes wire gripping features 258 for holding the wire 104 in the wire channel 256, such as by a friction fit. For example, the wire gripping features 258 may be serrations, grooves, protrusions, or other features to axially hold the wire 104 in the wire channel 256.

In an exemplary embodiment, the wire clamp 208 is pivotably coupled to the carriage body 240 proximate to the wire channel 256. For example, the wire clamp 208 may be coupled to the top 250 of the carriage body 240. The wire clamp 208 includes a clamp lever 260 operable to move the wire clamp 208 between a clamped position and a released position. Optionally, the clamp lever 260 is spring actuated. The clamp lever 260 may be lockable in the clamped position and/or the released position. In an exemplary embodiment, the wire clamp 208 includes a clamping finger 262 at a distal end of the wire clamp 208. The clamping finger 262 is configured to engage the wire 104 and hold the wire 104 in the carriage 206. The clamping finger 262 is movable when the clamp lever 260 is actuated between the clamped position and the released position.

Figure 3:
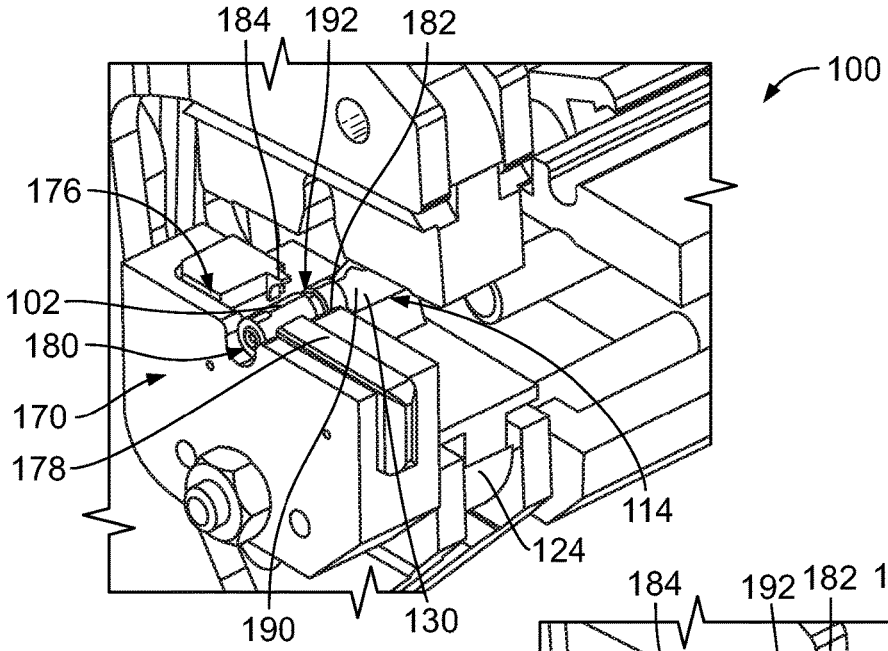
FIG. 3 is a perspective view of a portion of the hand crimp tool showing a terminal positioned in a terminal locator in accordance with an exemplary embodiment.
Figure 4:
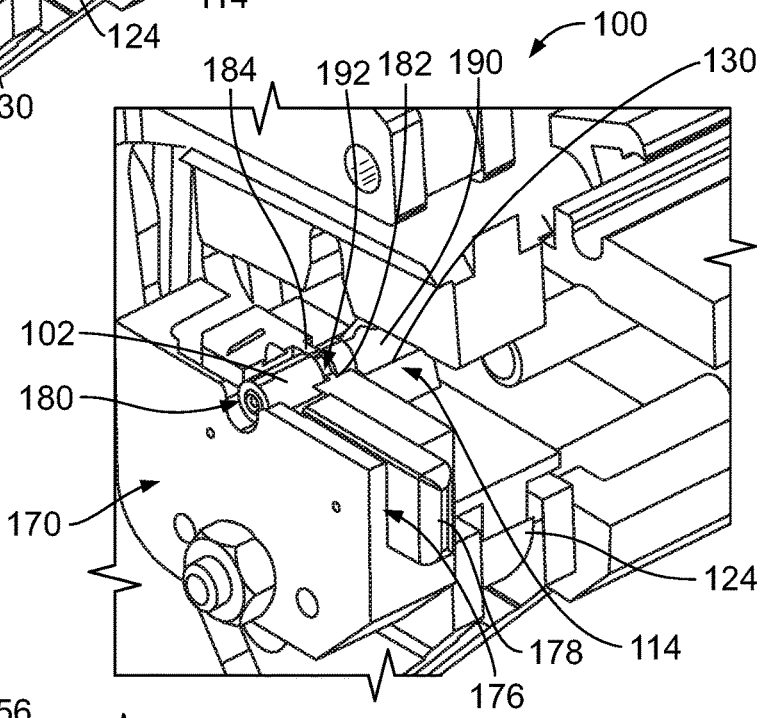
FIG. 4 is a perspective view of a portion of the hand crimp tool showing a terminal positioned in a terminal locator in accordance with an exemplary embodiment.

FIGS. 3 through 12 illustrate the hand crimp tool 100 in various stages of operation. FIGS. 3 and 4 are perspective views of a portion of the hand crimp tool 100 showing the terminal 102 positioned in the terminal locator 170. The terminal locator 170 positions the terminal 102 in the crimp zone 114 such that a crimp barrel 190 of the terminal 102 is axially aligned with the anvil 124 and supported on the terminal support 130. FIG. 3 illustrates the terminal lock 178 in an unlocked position. FIG. 4 illustrates the terminal lock 178 in a locked position.

In an exemplary embodiment, the terminal locator 170 includes a locating feature 182 extending into the terminal channel 180 to locate the terminal 102 in the terminal channel 180. In the illustrated embodiment, the locating feature 182 is a tab extending into the terminal channel 180. Other types of locating features 182 may be provided in alternative embodiments. The locating feature 182 is received in a groove 192 of the terminal 102 to axially locate the terminal 102 within the terminal channel 180.

The terminal lock 178 is slidable within the slot 176 between the locked position and the unlocked position. In an exemplary embodiment, the terminal lock 178 is spring loaded in the slot 176 and biased to the locked position. When the terminal lock 178 is pushed rearward, the terminal 102 may be loaded into the terminal channel 180 and/or removed from the terminal channel 180. When the terminal lock 178 is released, the biasing spring forces the terminal lock 178 to the locked position. A locking feature 184 of the terminal lock 178 engages the terminal 102 to lock the terminal 102 in the terminal channel 180. For example, the locking feature 184 may be a tab received in the groove 192 of the terminal 102. The terminal lock 178 may stop axial movement and/or rotational movement of the terminal 102 within the terminal channel 180 in the locked position.

Figure 5:
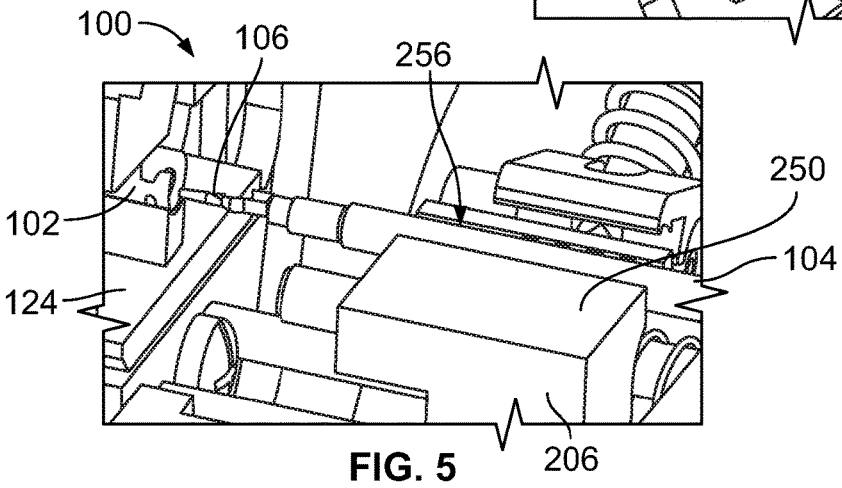
FIG. 5 is a perspective view of a portion of the hand crimp tool showing a wire loaded in a carriage of the wire inserter in accordance with an exemplary embodiment.

FIG. 5 is a perspective view of a portion of the hand crimp tool 100 showing the wire 104 loaded in the carriage 206. The wire 104 is loaded in the wire channel 256, such as from above the top 250 of the carriage 206. FIG. 5 illustrates the wire clamp 208 in the released position. In an exemplary embodiment, the end of the wire 104 is prepared prior to loading the wire 104 into the carriage 206. For example, the contact 106 may be crimped to the end of the center conductor of the wire 104. A portion of the shield may be exposed by removing a portion of the outer jacket of the wire 104. The end of the wire 104 extends beyond the carriage 206 and is axially aligned with the terminal 102. In an exemplary embodiment, the end of the contact 106 is positioned adjacent the back end of the terminal 102, such as approximately flush with the back end of the terminal 102 and/or the anvil 124. When the carriage 206 is released and advanced the end of the wire 104 may be spring loaded into the terminal 102.

Figure 6:
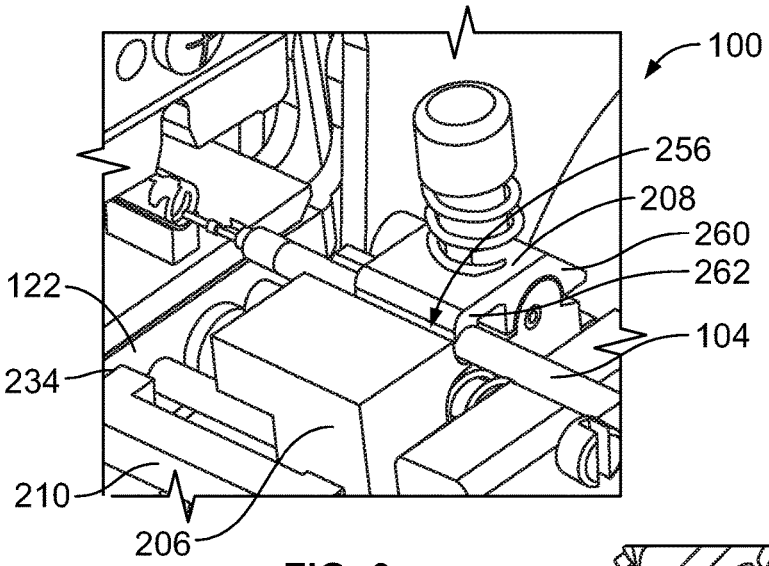
FIG. 6 is a perspective view of a portion of the hand crimp tool showing a wire clamp of the wire inserter in the clamped position in accordance with an exemplary embodiment.

FIG. 6 is a perspective view of a portion of the hand crimp tool 100 showing the wire clamp 208 in the clamped position. The clamp lever 260 is actuated to rotate the clamping finger 262 to the clamped position. The clamping finger 262 engages the wire 104 and holds the wire 104 in the wire channel 256 in the clamped position. In an exemplary embodiment, the wire 104 is loaded in the carriage 206 when the carriage 206 is in the retracted position. In an exemplary embodiment, the carriage lock 210 holds the carriage 206 in the retracted position. For example, the second end 234 of the carriage lock 210 abuts against the lower jaw 122 and prevents movement of the carriage 206 in the advancing direction.

Figure 7:
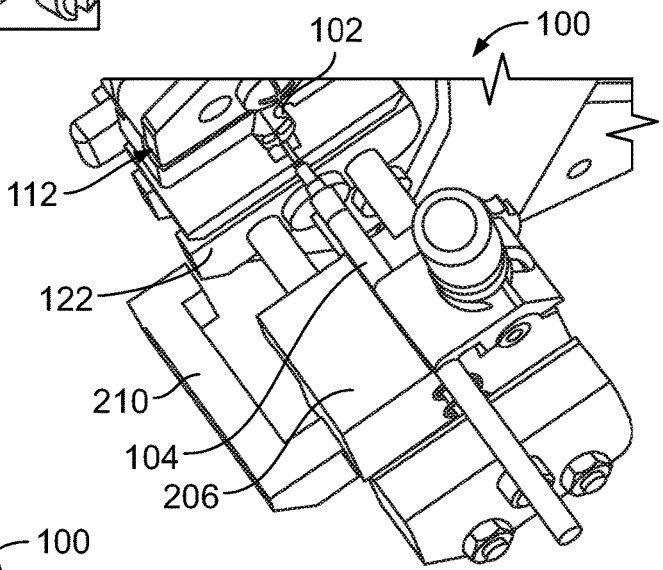
FIG. 7 is a perspective view of a portion of the hand crimp tool showing a carriage lock of the wire inserter in accordance with an exemplary embodiment.

FIG. 7 is a perspective view of a portion of the hand crimp tool 100 showing the carriage lock 210 unlocked from the head 112 to allow the carriage 206 to advance in the advancing direction. In the illustrated embodiment, the carriage lock 210 is slid outward such that the second end 234 has clearance beyond the lower jaw 122. Once the carriage lock 210 clears the lower jaw 122, the carriage 206 is allowed to advance in the advancing direction to load the wire 104 into the terminal 102.

Figure 8:
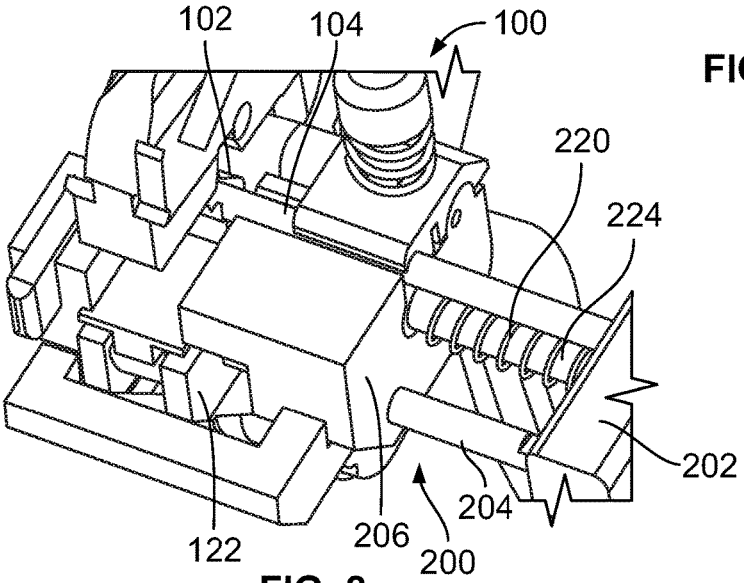
FIG. 8 is a perspective view of a portion of the hand crimp tool showing the wire loaded into the terminal in accordance with an exemplary embodiment.

FIG. 8 is a perspective view of a portion of the hand crimp tool 100 showing the wire 104 loaded into the terminal 102. The carriage 206 is advanced to the advanced position by the biasing mechanism 220. The carriage 206 slides along the guide rails 204 to the advanced position. The biasing mechanism 220 pushes the carriage 206 away from the end piece 202 to load the wire 104 into the terminal 102. The biasing force of the biasing mechanism 220 defines the loading force of the wire 104 into the terminal 102. The guide rails 204 control the direction of movement of the carriage 206 in the advancing direction and the biasing mechanism 220 controls the depth of movement of the carriage 206 in the advancing direction during positioning of the wire 104 by the wire inserter 200. The biasing mechanism 220 maintains the loading force on the wire 104 in the terminal 102 during the crimping process. In an exemplary embodiment, the carriage 206 is free-floating relative to the lower jaw 122 in the advanced position. For example, clearance is provided between the carriage 206 and the lower jaw 122 that would allow the carriage 206 to advance further, such as if a higher loading force is desired.

Optionally, the wire 104 may have a minimum loading force and a maximum loading force. The biasing force of the biasing mechanism 220 is sufficient to provide a loading force that is greater than the minimum loading force and less than the maximum loading force. For example, the minimum loading force may be based on the force required to insert the contact 106 beyond locating features of the terminal 102, such as barbs within the terminal 102. In various embodiments, the minimum loading force may be approximately 10 Newtons. The maximum loading force may be defined by the locating features within the terminal 102 and may be selected so that the contact 106 does not damage the locating features within the terminal 102 during loading. In various embodiments, the maximum loading force may be approximately 20 Newtons. In an exemplary embodiment, the biasing force may be selected to provide a loading force that is approximately centered between the minimum loading force and the maximum loading force, such as approximately 15 Newtons. The loading force may be adjusted by actuating the force adjustment mechanism 224.

Figure 9:
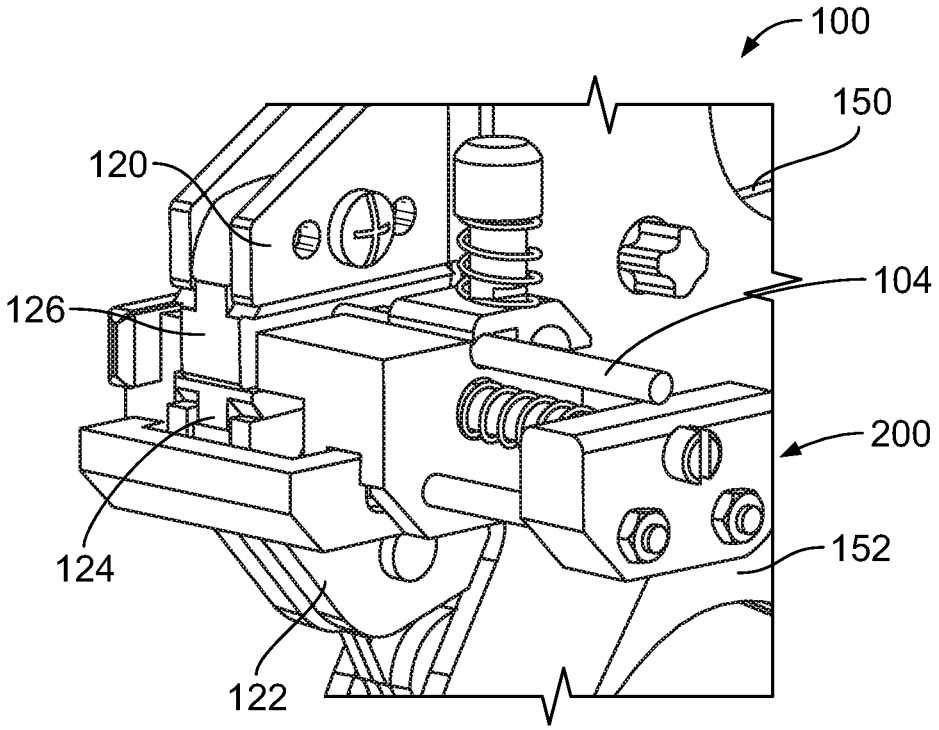
FIG. 9 is a perspective view of a portion of the hand crimp tool showing the terminal in accordance with an exemplary embodiment.

FIG. 9 is a perspective view of a portion of the hand crimp tool 100 showing the terminal 102 crimped between the anvil 124 and the crimper 126. The upper jaw 120 and/or the lower jaw 122 are closed during the crimping process to crimp the terminal 102 to the wire 104. The upper handle 150 and/or the lower handle 152 are hand squeezed by the operator to close the hand crimp tool 100 during the crimping process. The wire inserter 200 holds the wire 104 in the terminal 102 during the crimping process. The loading force on the wire 104 is maintained through the crimping process.

Figure 10:
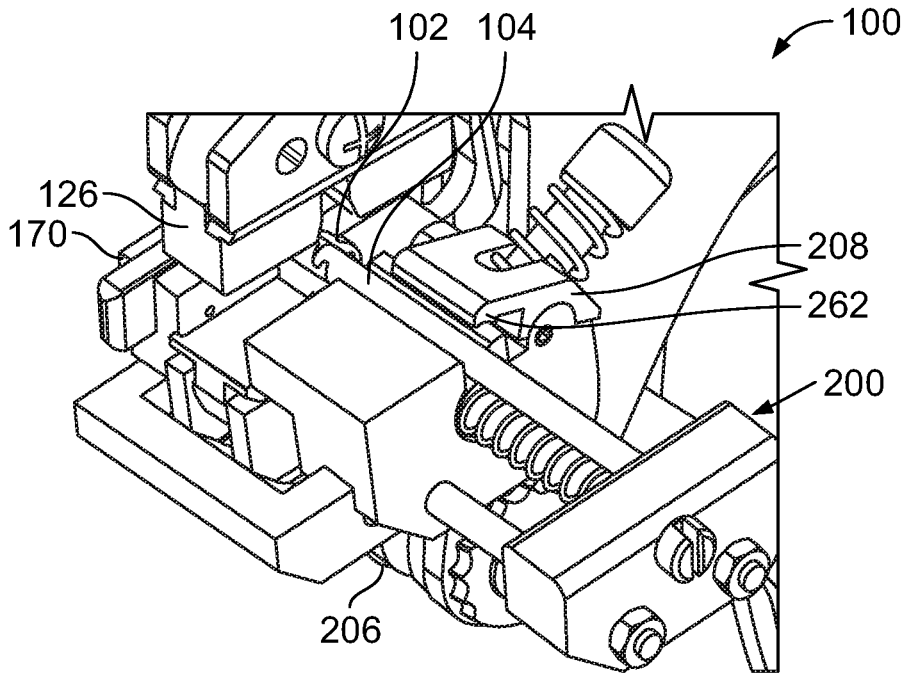
FIG. 10 is a perspective view of a portion of the hand crimp tool showing the wire clamp in a released position in accordance with an exemplary embodiment.

FIG. 10 is a perspective view of a portion of the hand crimp tool 100 showing the crimper 126 open and showing the wire clamp 208 in the released position. After the terminal 102 is crimped to the wire 104, the wire 104 may be released from the wire inserter 200. For example, the wire clamp 208 is moved to the released position to release the clamping finger 262 from the wire 104. When the wire clamp 208 is released, the carriage 206 may be movable relative to the wire 104. For example, the terminal 102 is crimped to the wire 104 and held in the terminal locator 170, but the carriage 206 may be moved to the retracted position without moving the wire 104 or the terminal 102.

Figure 11:
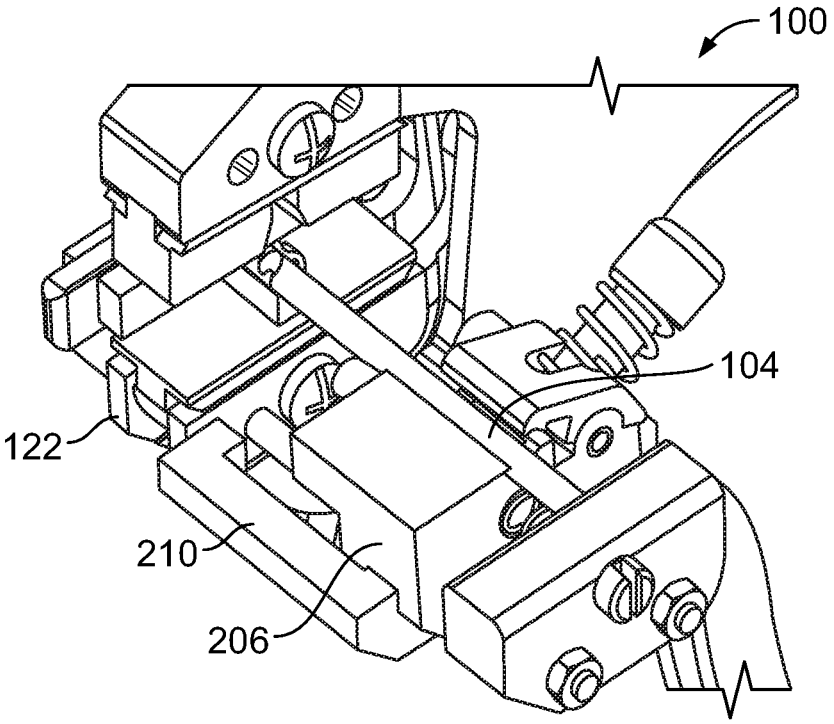
FIG. 11 is a perspective view of a portion of the hand crimp tool showing the carriage in a retracted position in accordance with an exemplary embodiment.

FIG. 11 is a perspective view of a portion of the hand crimp tool 100 showing the carriage 206 moved to the retracted position. In an exemplary embodiment, the carriage 206 is moved by hand relative to the wire 104 in a retracting direction. Once the carriage 206 is moved to the retracted position, the carriage lock 210 may be actuated and moved to a locked position to lock the carriage 206 in the retracted position relative to the lower jaw 122.

Figure 12:
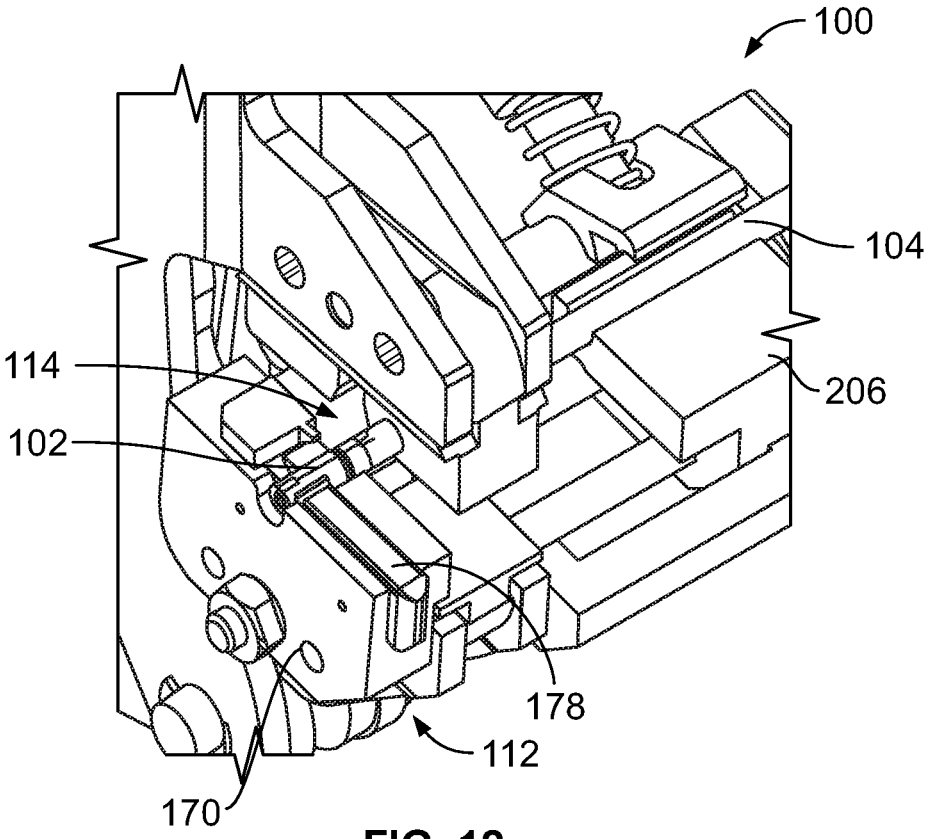
FIG. 12 is a perspective view of a portion of the hand crimp tool showing the terminal lock unlocked from the terminal in accordance with an exemplary embodiment.

FIG. 12 is a perspective view of a portion of the hand crimp tool 100 showing the terminal lock 178 unlocked from the terminal 102. The terminal lock 178 is unlocked to release the terminal 102 from the terminal locator 170 and the head 112. The wire 104 and the terminal 102 may be removed from the crimp zone 114 after the terminal lock 178 is unlocked. In other various embodiments, the terminal lock 178 may be unlocked and the terminal 102 and the wire 104 removed from the crimp zone 114 prior to retracting the carriage 206 to the retracted position.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A hand crimp tool comprising:

a handle including an upper handle and a lower handle movable relative to each other to open and close the hand crimp tool, the upper handle including an upper handgrip, the lower handle including a lower handgrip, the upper handgrip and the lower handgrip configured to be hand squeezed to close the hand crimp tool;

a head having an upper jaw operably coupled to the upper handle and a lower jaw operably coupled to the lower handle, the head including a crimp zone between the upper jaw and the lower jaw, the lower jaw including an anvil configured to hold a terminal, the upper jaw including a crimper configured to crimp the terminal between the anvil and the crimper when the hand crimp tool is closed; and a wire inserter coupled to the head, the wire inserter including a carriage movable between an advanced position and a retracted position, the wire inserter having a wire clamp holding a wire in the carriage, the wire inserter moving the wire relative to the head to position and hold the wire in the terminal during crimping of the terminal between the anvil and the crimper, wherein the wire inserter includes a carriage lock operably coupled to the carriage, the carriage lock locking the carriage in the retracted position, the carriage lock being released to move the carriage to the advanced position.

2. The hand crimp tool of claim 1, wherein the wire inserter includes a biasing mechanism coupled to the carriage, the biasing mechanism biasing the carriage toward the advanced position to load the wire into the terminal.

3. The hand crimp tool of claim 2, wherein the biasing mechanism applies a biasing force on the carriage to spring load the wire in the terminal at a predetermined loading force during crimping of the terminal.

4. The hand crimp tool of claim 3, wherein the wire inserter includes a force adjustment mechanism operable to adjust the loading force.

5. The hand crimp tool of claim 2, wherein the wire inserter includes an end piece coupled to the head by guide rails, the carriage positioned between the end piece and the head on the guide rails and sliding on the guide rails between the retracted position and the advanced position, the biasing mechanism being positioned between the end piece and the carriage.

6. The hand crimp tool of claim 5, wherein the guide rails control a direction of movement of the carriage in an advancing direction during positioning of the wire by the wire inserter, and wherein the biasing mechanism controls a depth of movement of the carriage in the advancing direction during positioning of the wire by the wire inserter.

7. The hand crimp tool of claim 1, further comprising a terminal locator coupled to the head proximate to the anvil, the terminal locator having a terminal channel configured to receive the terminal oriented relative to the anvil, the terminal locator having a terminal lock configured to lock the terminal in the terminal channel.

8. The hand crimp tool of claim 7, wherein the terminal locator includes a locating feature configured to engage the terminal to locate the terminal in the terminal channel relative to the anvil.

9. The hand crimp tool of claim 1, wherein the wire clamp includes a clamping finger configured to engage the wire and hold the wire in the carriage, the wire clamp having a clamp lever operable to move the wire clamp between a clamped position and a released position.

10. A hand crimp tool comprising:

a handle including an upper handle and a lower handle movable relative to each other to open and close the hand crimp tool, the upper handle including an upper handgrip, the lower handle including a lower handgrip, the upper handgrip and the lower handgrip configured to be hand squeezed to close the hand crimp tool;

a head having an upper jaw operably coupled to the upper handle and a lower jaw operably coupled to the lower handle, the head including a crimp zone between the upper jaw and the lower jaw, the lower jaw including an anvil configured to hold a terminal, the upper jaw including a crimper configured to crimp the terminal between the anvil and the crimper when the hand crimp tool is closed; and a wire inserter coupled to the head, the wire inserter including a carriage movable between an advanced position and a retracted position, the wire inserter having a wire clamp holding a wire in the carriage, the wire inserter moving the wire relative to the head to position and hold the wire in the terminal during crimping of the terminal between the anvil and the crimper, the wire inserter including a biasing mechanism coupled to the carriage, the wire inserter including an end piece coupled to the head by guide rails, the carriage positioned between the end piece and the head on the guide rails and sliding on the guide rails between the retracted position and the advanced position, the biasing mechanism being positioned between the end piece and the carriage, the biasing mechanism biasing the carriage toward the advanced position to load the wire into the terminal.

11. The hand crimp tool of claim 10, wherein the biasing mechanism applies a biasing force on the carriage to spring load the wire in the terminal at a predetermined loading force during crimping of the terminal, the wire inserter including a force adjustment mechanism operable to adjust the loading force.

12. The hand crimp tool of claim 10, wherein the guide rails control a direction of movement of the carriage in an advancing direction during positioning of the wire by the wire inserter, and wherein the biasing mechanism controls a depth of movement of the carriage in the advancing direction during positioning of the wire by the wire inserter.

13. The hand crimp tool of claim 10, wherein the wire inserter includes a carriage lock operably coupled to the carriage, the carriage lock locking the carriage in the retracted position, the carriage lock being released to move the carriage to the advanced position.

14. The hand crimp tool of claim 10, further comprising a terminal locator coupled to the head proximate to the anvil, the terminal locator having a terminal channel configured to receive the terminal oriented relative to the anvil, the terminal locator having a terminal lock configured to lock the terminal in the terminal channel, the terminal locator including a locating feature configured to engage the terminal to locate the terminal in the terminal channel relative to the anvil.

15. The hand crimp tool of claim 10, wherein the wire clamp includes a clamping finger configured to engage the wire and hold the wire in the carriage, the wire clamp having a clamp lever operable to move the wire clamp between a clamped position and a released position.

16. A hand crimp tool comprising:

a handle including an upper handle and a lower handle movable relative to each other to open and close the hand crimp tool, the upper handle including an upper handgrip, the lower handle including a lower handgrip, the upper handgrip and the lower handgrip configured to be hand squeezed to close the hand crimp tool;

a head having an upper jaw operably coupled to the upper handle and a lower jaw operably coupled to the lower handle, the head including a crimp zone between the upper jaw and the lower jaw, the lower jaw including an anvil configured to hold a terminal, the upper jaw including a crimper configured to crimp the terminal between the anvil and the crimper when the hand crimp tool is closed;

a terminal locator coupled to the head proximate to the anvil, the terminal locator having a terminal channel configured to receive the terminal oriented relative to the anvil, the terminal locator having a terminal lock configured to lock the terminal in the terminal channel, the terminal locator including a locating feature configured to engage the terminal to locate the terminal in the terminal channel relative to the anvil; and a wire inserter coupled to the head, the wire inserter including a carriage movable between an advanced position and a retracted position, the wire inserter having a wire clamp holding a wire in the carriage, the wire inserter moving the wire relative to the head to position and hold the wire in the terminal during crimping of the terminal between the anvil and the crimper.

17. The hand crimp tool of claim 16, wherein the wire inserter includes a carriage lock operably coupled to the carriage, the carriage lock locking the carriage in the retracted position, the carriage lock being released to move the carriage to the advanced position.

18. The hand crimp tool of claim 16, wherein the wire inserter includes a biasing mechanism coupled to the carriage, the biasing mechanism biasing the carriage toward the advanced position to load the wire into the terminal, the biasing mechanism applies a biasing force on the carriage to spring load the wire in the terminal at a predetermined loading force during crimping of the terminal, the wire inserter including a force adjustment mechanism operable to adjust the loading force.

19. The hand crimp tool of claim 16, wherein the wire inserter includes a biasing mechanism coupled to the carriage, the biasing mechanism biasing the carriage toward the advanced position to load the wire into the terminal, the wire inserter including an end piece coupled to the head by guide rails, the carriage positioned between the end piece and the head on the guide rails and sliding on the guide rails between the retracted position and the advanced position, the biasing mechanism being positioned between the end piece and the carriage.

20. The hand crimp tool of claim 19, wherein the guide rails control a direction of movement of the carriage in an advancing direction during positioning of the wire by the wire inserter, and wherein the biasing mechanism controls a depth of movement of the carriage in the advancing direction during positioning of the wire by the wire inserter.

* * * * *